US009890511B1

(12) United States Patent
Adams

(10) Patent No.: US 9,890,511 B1
(45) Date of Patent: Feb. 13, 2018

(54) ROCK BOLT SEAL

(71) Applicant: Lyle Kenneth Adams, Campbell River (CA)

(72) Inventor: Lyle Kenneth Adams, Campbell River (CA)

( * ) Notice: Subject to any disclaimer, the term of this patent is extended or adjusted under 35 U.S.C. 154(b) by 0 days.

(21) Appl. No.: 15/435,049

(22) Filed: Feb. 16, 2017

(30) Foreign Application Priority Data

Feb. 13, 2017 (CA) ..... 2957748

(51) Int. Cl.
*E02D 5/80* (2006.01)

(52) U.S. Cl.
CPC ..... *E02D 5/808* (2013.01); *E02D 2200/1685* (2013.01); *E02D 2300/0001* (2013.01); *E02D 2300/0003* (2013.01); *E02D 2300/0018* (2013.01); *E02D 2450/105* (2013.01); *E02D 2600/30* (2013.01)

(58) Field of Classification Search
CPC .... E02D 5/808; E02D 20/025; E21D 21/0086
See application file for complete search history.

(56) References Cited

U.S. PATENT DOCUMENTS 4,139,323 A 2/1979 Brandstetter
4,183,699 A 1/1980 Donan, Jr. et al.
4,188,158 A 2/1980 Donan, Jr. et al.
4,253,781 A 3/1981 Fischer et al.
4,289,427 A 9/1981 Rolston
4,300,859 A 11/1981 Donan, Jr.
4,369,003 A 1/1983 Brandstetter
4,397,589 A 8/1983 Darroussin et al.
4,423,986 A 1/1984 Skogberg
4,444,529 A 4/1984 Kallio et al.
4,449,855 A 5/1984 Langwadt
4,498,817 A 2/1985 Oulsnam
4,601,614 A 7/1986 Lane et al.
4,693,638 A 9/1987 Unrug et al.
4,711,604 A 12/1987 Heimsoth et al.
4,746,248 A * 5/1988 Lillis ..... E21D 21/0086 405/259.5
4,842,063 A 6/1989 Coetzee et al.
4,850,746 A 7/1989 Finsterwalder et al.
4,952,097 A 8/1990 Kulchin
4,983,076 A * 1/1991 Vidal ..... E02D 29/0266 405/262
5,073,065 A 12/1991 Kleineke
5,423,635 A 6/1995 Keller et al.
5,458,442 A 10/1995 Ashmore
(Continued)

*Primary Examiner* — Tara Mayo-Pinnock
(74) *Attorney, Agent, or Firm* — Smith, Gambrell & Russell, LLP

(57) ABSTRACT

The invention provides a seal for placement between a washer plate of a rock bolt and a rock face, wherein the washer plate has an outer edge at a perimeter thereof and wherein the rock bolt has a longitudinal axis, wherein the seal comprises a body made of a spongy material, wherein the body is planar and has an outer dimension that matches that or that is larger than that of outer edge of the washer plate and an inner dimension that has a void towards the center of the inner dimension through-which the longitudinal axis of the rock bolt can pass. The seal is for preventing the leakage of cementing grout (that is used in securing the rock bolt in a bore hole in a mass of rock below a rock face) between the washer plate and the rock face.

9 Claims, 3 Drawing Sheets

(56) References Cited

U.S. PATENT DOCUMENTS

| | | | | |
|---|---|---|---|---|
| 5,636,945 | A | 6/1997 | Nes | |
| 5,885,034 | A | 3/1999 | Fergusson | |
| 6,312,196 | B1 | 11/2001 | Mansfield | |
| 6,428,243 | B1 | 8/2002 | Hutchins | |
| 6,474,910 | B2 | 11/2002 | Lay | |
| 6,640,511 | B1 * | 11/2003 | Link | E04D 3/3603 52/410 |
| 6,863,476 | B2 | 3/2005 | Malkoski | |
| 7,029,204 | B1 | 4/2006 | Webber et al. | |
| 7,077,195 | B2 | 7/2006 | Zotta | |
| 7,381,013 | B1 | 6/2008 | Rataj et al. | |
| 7,648,311 | B2 | 1/2010 | Hedrick | |
| 7,866,922 | B2 | 1/2011 | Melegari | |
| 7,896,580 | B2 | 3/2011 | Weaver et al. | |
| 8,240,958 | B2 | 8/2012 | Eigemann et al. | |
| 8,434,970 | B2 | 5/2013 | Gaudry et al. | |
| 8,678,729 | B2 | 3/2014 | Salgado | |
| 8,931,236 | B2 | 1/2015 | Sinclair | |
| 8,967,916 | B2 | 3/2015 | Hussey et al. | |
| 9,004,820 | B2 | 4/2015 | Wang et al. | |
| 2001/0046418 | A1 | 11/2001 | Lay | |
| 2003/0219316 | A1 | 11/2003 | Rataj | |
| 2004/0136788 | A1 | 7/2004 | Hindle | |
| 2005/0042037 | A1 | 2/2005 | Maltby | |
| 2006/0093438 | A1 | 5/2006 | Fergusson | |
| 2007/0177949 | A1 | 8/2007 | Koehler et al. | |
| 2007/0183850 | A1 | 8/2007 | Hedrick | |
| 2009/0220309 | A1 | 9/2009 | Weaver et al. | |
| 2009/0297279 | A1 | 12/2009 | Weaver et al. | |
| 2009/0324343 | A1 | 12/2009 | Eigemann et al. | |
| 2010/0003088 | A1 | 1/2010 | Grocholewski et al. | |
| 2010/0098500 | A1 | 4/2010 | Weaver et al. | |
| 2010/0202838 | A1 | 8/2010 | Weaver et al. | |
| 2011/0135402 | A1 | 6/2011 | Leppanen | |
| 2012/0039672 | A1 | 2/2012 | Hall et al. | |
| 2012/0251262 | A1 | 10/2012 | Hidalgo Salgado | |
| 2012/0282039 | A1 | 11/2012 | Hussey et al. | |
| 2014/0270983 | A1 | 9/2014 | Bennett | |
| 2015/0204152 | A1 | 7/2015 | Boehm et al. | |
| 2015/0322785 | A1 | 11/2015 | Ahola | |
| 2016/0177718 | A1 | 6/2016 | Cawood et al. | |

* cited by examiner

ROCK BOLT SEAL

FIELD OF THE INVENTION

This invention relates to rock bolts and, more particularly, to a seal used to prevent leakage of cementing grout from a bore hole when the cementing grout is being inserted in the bore hole during installation of the rock bolt.

BACKGROUND OF THE INVENTION

A rock bolt is an anchor bolt used for stabilizing a rock excavation during construction of a tunnel, for example a transportation tunnel or a mining tunnel. During construction of a tunnel, a cavity is created in a mass of rock. The interface between the remaining portion of the mass of rock and the underlying cavity is unstable, and a plurality of rock bolts are installed at the interface between the remaining mass of rock and the cavity in order to help stabilize the interface. The rock bolts stabilize the interface by transferring load from the unstable exterior of the rock mass at its interface with the cavity to the interior of the rock mass, which is much stronger and more stable.

An individual rock bolt can be one to twelve meters in length and is installed in an exposed rock face from the cavity side by boring a hole in the rock mass that is at least as long as the rock bolt and of a slightly bigger diameter. The rock bolt is placed in the hole, and a mechanism within the rock bolt is engaged to anchor the rock bolt into the hole towards the distal end of the rock bolt. The anchored rock bolt is then sealed within the hole by applying cementing grout into the hole, which hardens to seal the rock bolt in place. Not only does the cementing grout seal the rock bolt in place, the cementing grout acts as a coating for the metal parts of the rock bolt within the bore hole which protects these parts of the rock bolt from corrosion. A typical rock bolt which may be installed in this manner is shown in U.S. Pat. No. 5,636,945. Such a rock bolt is commercially available under the trademark CT BOLT® from Vik Oersta A/S—Rock Support, Strandgata 59, N-6151 Oersta, Norway.

Before hardening, the cementing grout is a runny paste which is injected into the rock bolt in such a manner (discussed in greater detail below in the Detailed Description of the Invention) that the bored hole surrounding the rock bolt is filled with the cementing grout. The rock bolt comprises a flange or washer plate towards its proximal end, with the flange or washer plate resting adjacent to the rock face, and the purposes of the flange or washer plate are (1) to position the rock bolt in place with its distal end in the hole and its proximal end outside the hole prior to engagement of the anchor mechanism and insertion of the cementing grout and (2) to help prevent the cementing grout from running out of the hole before the cementing grout hardens.

Unfortunately, the flange or washer plate does not do an adequate job at preventing the cementing grout from running out of the hole. As previously explained, the rock face is the interface between the rock remaining after rock is removed during excavation and the cavity created by the excavation. It is naturally a roughened surface, unless ground down or cemented over with a material such as shotcrete. Gaps will exist between the flange or washer plate and the rock face (or the rock face with the surface coating of the material such as shotcrete), and cementing grout can escape through these gaps before the cementing grout hardens. For ease of reference, the term "rock face" will be used herein to refer to a face of exposed rock and a face of exposed rock covered with a coating of a material such as shotcrete interchangeably.

Since the cementing grout is inserted into the hole through the rock bolt under pressure, cementing grout escaping through the gaps creates a mess at the worksite during installation of rock bolts. The mess created by the escaped cementing grout goes beyond the aesthetic. Bore holes into which cementing grout is inserted are often located in a rock mass overhead of where workers are installing the rock bolts and applying the cementing grout. Escaped cementing grout will land on the workers and worksite underneath, which is a health and safety hazard. Work must be stopped after a cementing grout leak to clean up the workers and worksite in order to eliminate the hazard of the escaped cementing grout. It is always a goal in any business to prevent, or at least lower the possibility of unnecessary work stoppages and workplace hazards, so practitioners in the field have tried to find a solution to the problem of cementing grout escaping during the grouting process during installation of rock bolts.

Practitioners in the field have previously tried to plug these gaps with rags at the first sign of cementing grout escaping through a gap. This solution is unsatisfactory since it is reactionary—one must detect escaping cementing grout before a gap is plugged with a rag. Time is taken away from the job of installing a rock bolt when one has to detect and plug leaks manually, and further time is taken away since one still has to clean up the cementing grout that has leaked out of the gaps prior to insertion of the rag plug. Another solution is to apply a resin-based substance to fill gaps between the flange or washer plate and the rock face prior to insertion of the cementing grout. Such a substance that has been used in the past is made of an isocyanate polyol resin with flame retardants and amine catalysts added. This substance is inserted in the gaps as a liquid which forms an expanding resin-based foam which fills the gaps. While this solution is proactive since it fills the gaps before cementing grout is installed and can escape through gaps, this solution is also unsatisfactory since one must wait for the substance to harden before cementing grout can be installed, thereby increasing the time taken to apply cementing grout by making the grouting process a two-step process. Workers first have to place a rock bolt in a bore hole and fill gaps with the resin-based substance, wait for the substance to harden and then, in a second step, revisit the rock bolt after the substance has hardened to insert the cementing grout. Such a two-step process with installers revisiting the workspace a second time increases expenses for an installing contractor and always introduces the possibility that certain rock bolts are missed in the second step and are not cemented in place with cementing grout.

The present invention provides a seal for placement between the flange or washer plate and the rock face. The seal will plug potential leaks proactively in an installation process wherein the installing workers do not have to wait for the seal to harden before inserting the cementing grout.

SUMMARY OF THE INVENTION

According to one aspect of the present invention, there is provided a seal for placement between a washer plate of a rock bolt and a rock face, wherein the washer plate has an outer edge at a perimeter thereof and wherein the rock bolt has a longitudinal axis, wherein the seal comprises a body made of a spongy material, wherein the body is planar and has an outer dimension that matches that or that is larger than that of outer edge of the washer plate and an inner dimension that has a void towards the center of the inner dimension through-which the longitudinal axis of the rock bolt can pass.

According to another aspect of the present invention, there is provided a seal as described herein, wherein the spongy material is a flexible, resilient and water-resistant material.

According to yet another aspect of the present invention, there is provided a seal as described herein, wherein the flexible, resilient and water-resistant material comprises one or more materials selected from the group consisting of polyurethane foam rubber, latex foam rubber and neoprene.

According to still another aspect of the present invention, there is provided a seal as described herein, wherein the flexible, resilient and water-resistant material is carpet underlay.

According to a further aspect of the present invention, there is provided a seal as described herein, wherein the flexible, resilient and water resistant material comprises one or more materials selected from the group consisting of waffle rubber, urethane foam, and bonded urethane.

According to still a further aspect of the present invention, there is provided a seal as described herein, wherein the spongy material is of about 10 mm thickness.

According to yet a further aspect of the present invention, there is provided a seal as described herein, wherein the void through which the longitudinal axis of the rock bolt can pass allows for an airspace between the inner dimension of the seal and the longitudinal axis of the rock bolt.

BRIEF DESCRIPTION OF THE DRAWINGS

The prior art and embodiments of the invention are described with reference to the drawings, wherein.

DETAILED DESCRIPTION OF THE INVENTION

Figure 1:
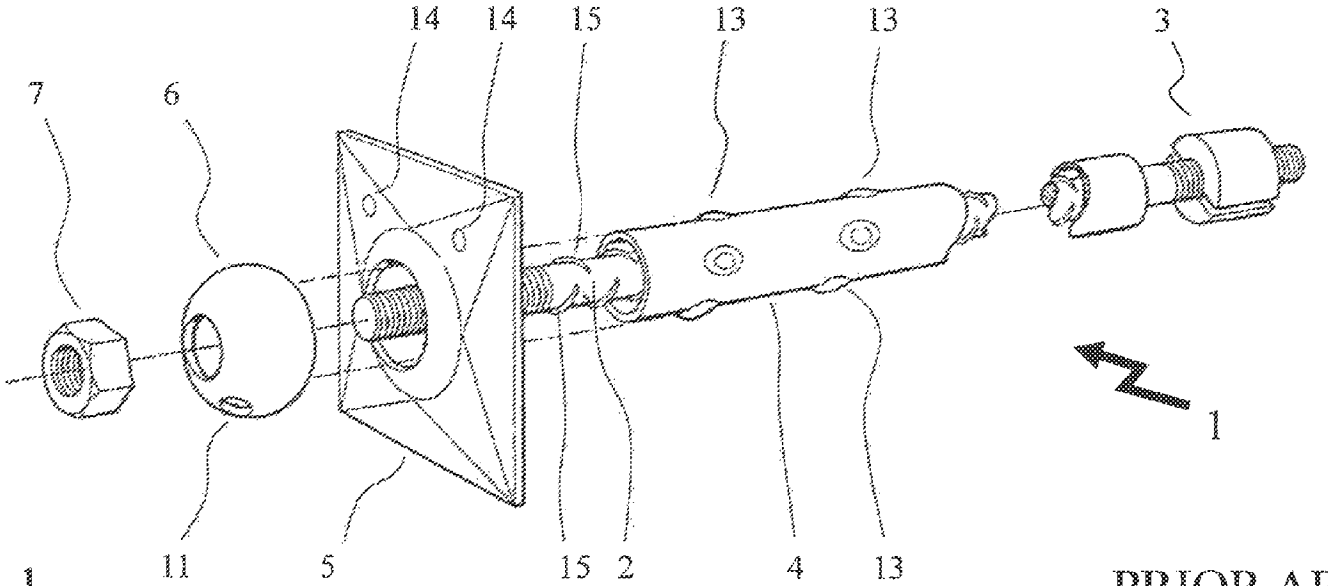
PRIOR ART FIG. 1
FIG. 1 is an exploded perspective view of a prior art rock bolt prior to installation [PRIOR ART]
Figure 2:
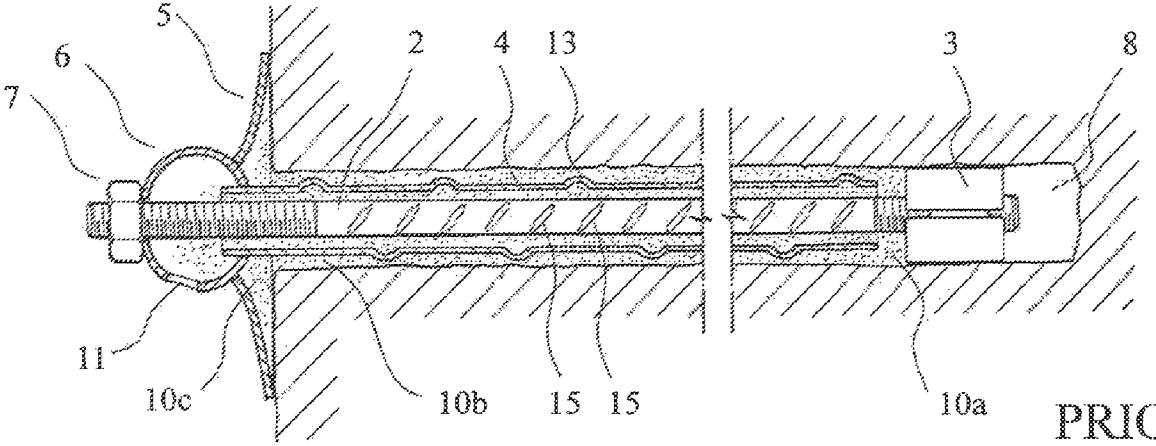
PRIOR ART FIG. 2
FIG. 2 is a side elevational view, partially in cross-section, through the prior art rock bolt shown in FIG. 1, as installed [PRIOR ART]

Before the rock bolt seal of the present invention is described in detail, it will be useful to describe how a prior art rock bolt works with the aid of FIGS. 1 and 2. Not all rock bolts are exactly the same as the example shown in FIGS. 1 and 2, but this example is sufficient to show how the rock bolt seal of the present invention functions with an existing rock bolt.

FIG. 1 is an exploded perspective view of rock bolt 1, and FIG. 2 is a side elevational view, partially in cross-section, showing rock bolt 1 installed in a bore hole 8 drilled through rock face 9. Bolt 1 comprises a cylindrical rod 2 which is threaded at the proximal and distal ends thereof. Expansion bushing 3 is mounted on the threaded distal end of rod 2, and nut 7 is mounted on the threaded proximal end of rod 2. Rod 2 extends through the center of hollow cylindrical tube 4, between nut 7 and expansion bushing 3. The diameter of rod 2 is less than that of tube 4, leaving an airspace between the exterior surface of rod 2 and the interior surface of tube 4. Between nut 7 and the proximal end of tube 4, pressure sphere 6 and washer plate 5 are mounted on rod 2 through central openings in pressure sphere 6 and in washer plate 5. The proximal central opening of pressure sphere 6 matches the diameter of the threading at the proximal end of rod 2, and the distal central opening of pressure sphere 6 matches the exterior diameter of tube 4 such that the distal central opening of pressure sphere 6 is mounted on the exterior surface of tube 4. The central opening of washer plate 5 is larger than the diameter of tube 4. The central opening of washer plate 5 rests flush against the outer surface of pressure sphere 6, towards the distal end thereof, as is best seen in FIG. 2.

To install rock bolt 1 in bore hole 8, distal end of bolt 1 is inserted in bore hole 8. The diameter of expansion bushing 3 must be less than that of bore hole 8 when bolt 1 is first inserted into bore hole 8. Bolt 1 is inserted into bore hole 8 until the outer edge of washer plate 5 rests against rock face 9, leaving the proximal end of rod 2, together with pressure sphere 6 and nut 7 protruding from bore hole 8.

Once bolt 1 is in place in bore hole 8, nut 7 is tightened, which in turn causes expansion bushing 3 to expand until the diameter of the bushing matches the diameter of bore hole 8, thereby anchoring bolt 1 within bore hole 8.

Once bolt 1 is anchored in bore hole 8 via expansion bushing 3, bolt 1 is cemented in place with cementing grout. Cementing grout is applied under pressure through grouting orifice 11 in the outer surface of pressure sphere 6. As the central opening at the proximal end of pressure sphere 6 abuts the proximal threaded end of rod 2 and bolt 7 mounted thereon, and as the central opening at the distal end of pressure sphere 6 abuts the exterior surface of tube 4, cementing grout will fill the interior of pressure sphere 6 and, once pressure sphere 6 is filled, cementing grout will start to fill the airspace between the interior surface of tube 4 and the exterior surface of rod 2. As cementing grout is inserted through orifice 11, grout will work its way through the airspace between the interior surface of tube 4 and the exterior surface of rod 2 towards the distal end of rod 2, thereby pushing air out of the distal end of tube 4 into an airspace 10*a* defined by the distal end of tube 4, expansion bushing 3 and the wall of bore hole 8. Airspace 10*a* is continuous with airspace 10*b* between the wall of bore hole 8 and the exterior surface of tube 4 and the airspace 10*c* between rock face 9 and the interior surface of washer plate 5. Orifice 14 in washer plate 5 (two orifices 14 shown in the washer plate 5 in FIG. 1) allows air to escape from bore hole 8 as cementing grout is applied through orifice 11 in pressure sphere 6. As cementing grout is applied, the interior of tubing 4 is filled, and grout works its way into airspaces 10*a*, and 10*b*, eventually filling the airspace 10*c* between rock face 9 and the interior surface of washer plate 5. When cementing grout begins to escape orifice 14 in washer plate 5, the application of grout through orifice 11 can be stopped and the grout within bore hole 8 can be allowed to harden. Once the grout hardens, rock bolt 1 is cemented into bore hole 8.

One or more of the interior surface of tube 4, the exterior surface of tube 4 and the exterior surface of rod 2 can be affixed with protuberances which will strengthen the cementing of rock bolt 1 in bore hole 8 once the cementing grout hardens. FIGS. 1 and 2 show such protuberances as bumps 13 on tube 4 and ridges 15 on rod 2.

So long as rock face 9 is smooth or has been treated with a coating of a material such as shotcrete that has been allowed to harden to a smooth finish, the outer edges of washer plate 5 will abut rock face 9 without gaps existing between the outer edges of washer plate 5 and rock face 9. As illustrated in FIG. 2, rock face 9 is smooth. However, one could easily envisage rock face 9 being a roughened surface with jagged edges. If rock face 9 were not smooth, gaps would exist between rock face 9 and the outer edges of washer plate 5, and cementing grout would easily leak out of these gaps before the grout hardened. While this leaked grout would undoubtedly create a mess (and as previously described, a resulting health and safety hazard) that would have to be cleaned up, one can easily understand that if a significant amount of grout leaks out of bore hole 8 before the grout hardens, less hardened grout will end up in the bore hole, thereby weakening the bond between the rock bolt 1 and the rock outside of bore hole 8.

Figure 3A:
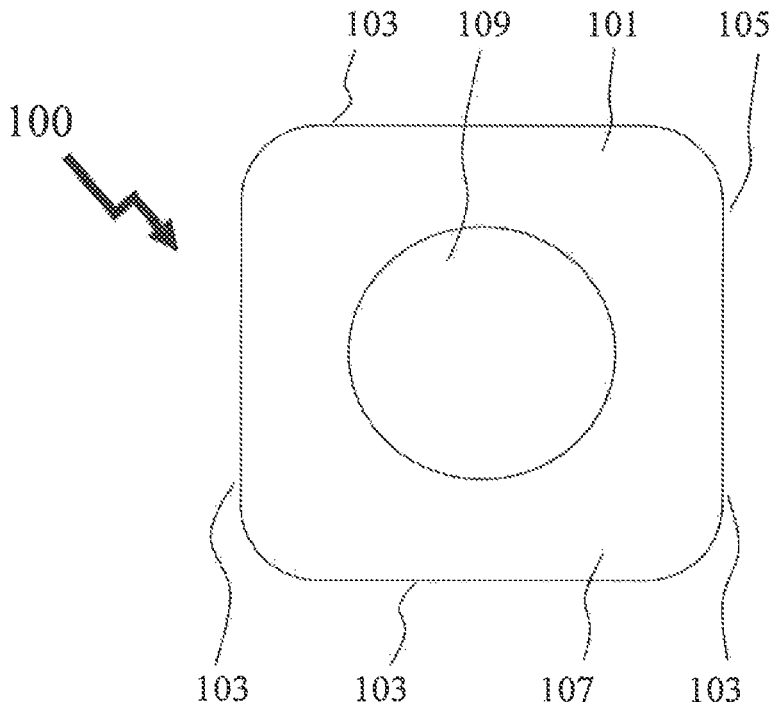
FIG. 3A is a top plan view of the rock bolt seal of the present invention, shown in isolation of a rock bolt.

The present invention is illustrated in isolation in FIG. 3*a*. The invention is a seal 100 which comprises a body 101 made of a spongy material. Body 101 is planar with external edges 103 that define an outer dimension 105. Within the outer edges 103, body 101 has an inner dimension 107. Inner dimension 107 has a void 109, roughly at a center portion thereof. In the embodiment of FIG. 3*a*, void 109 is circle-shaped. However, void 109 can be any shape that will permit the diameter of tube 4 of bolt 1 that seal 100 will be used with to pass through the void 109. Ideally, void 109 will allow for an airspace between the exterior surface of tube 4 and the inner dimension 107 of the body 101 of seal 100 that will allow cementing grout to pass through void 109.

Figure 3B:
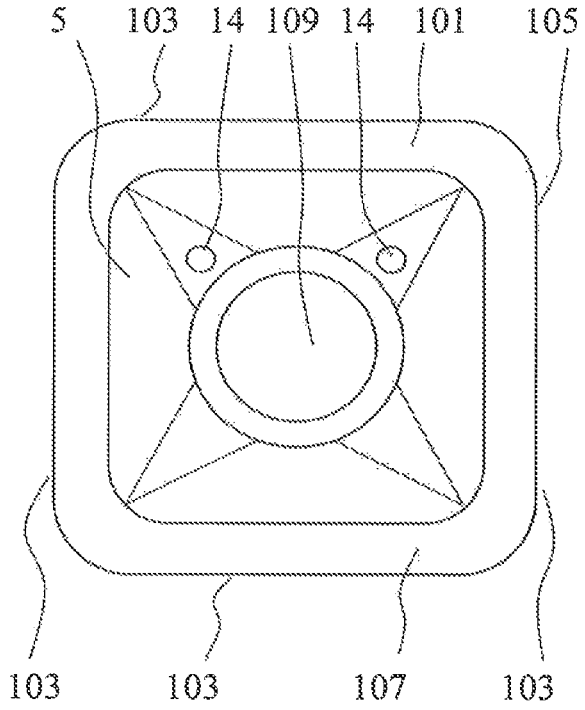
FIG. 3B is a top plan view of the rock bolt seal of the present invention, shown with the washer plate of a rock bolt resting in position above (proximal to) the rock bolt seal.

The outer dimension 105 of body 101 can best be understood when viewing FIG. 3*b*, which shows seal 100 in a top plan view with washer plate 5 resting above it. The opening at the center of washer plate 5 overlaps the void 109 at the center of the inner dimension 107 of body 101. Outer edges 103 of body 101 roughly match the outer edges of washer plate 5. In the embodiment shown in FIG. 3*b*, washer plate is roughly square-shaped, so the outer edges 103 of body 101 define an outer dimension 105 that is also roughly square-shaped, but is slightly larger than the outer dimension of washer plate 5. If the outer dimension 105 of body 101 matches the outer dimension defined by the outer edges of washer plate 5, or if the outer dimension 105 of body 101 is larger than the outer dimension of washer plate 5, the spongy material of the inner dimension 107 of body 101 will fill gaps that can occur between the outer edges of washer plate 5 and rock face 9 when rock bolt 1 is installed and cemented in bore hole 8 as previously described.

The square-shaped seal 100 could also be used with a washer plate 5 of a different shape, so long as the outer edges of washer plate 5 rest within the outer dimension 105 such that the outer edges of washer plate 5 rest against the spongy material of the inner dimension 107 of the body 101 of seal 100. In an alternative embodiment, seal 100 could be differently shaped to better match the shape of washer plate 5. For example, if washer plate 5 were circle-shaped, the outer dimension 105 of body 101 could also be circle-shaped, so long as the outer dimension 105 of body 101 matched the outer dimension formed by the outer edge of circle-shaped washer plate 5, or was larger than the outer dimension of circle-shaped washer plate 5, and the outer edge of circle-shaped washer plate 5 rested against the spongy material of the inner dimension 107 of body 101 when washer plate 5 was pressed towards rock face 9 during installation of rock bolt 1.

Figure 4:
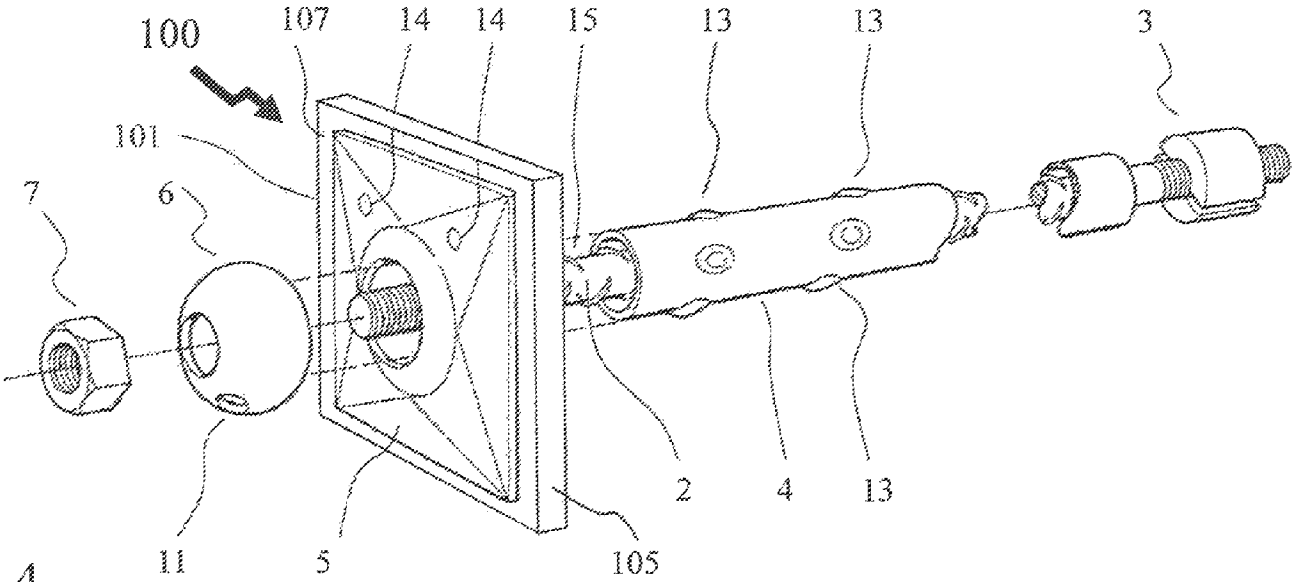
FIG. 4 is an exploded perspective view of the rock bolt seal of the present invention, showing the placement thereof prior to installation, when used in conjunction with the prior art rock bolt shown in FIG. 1.
Figure 5:
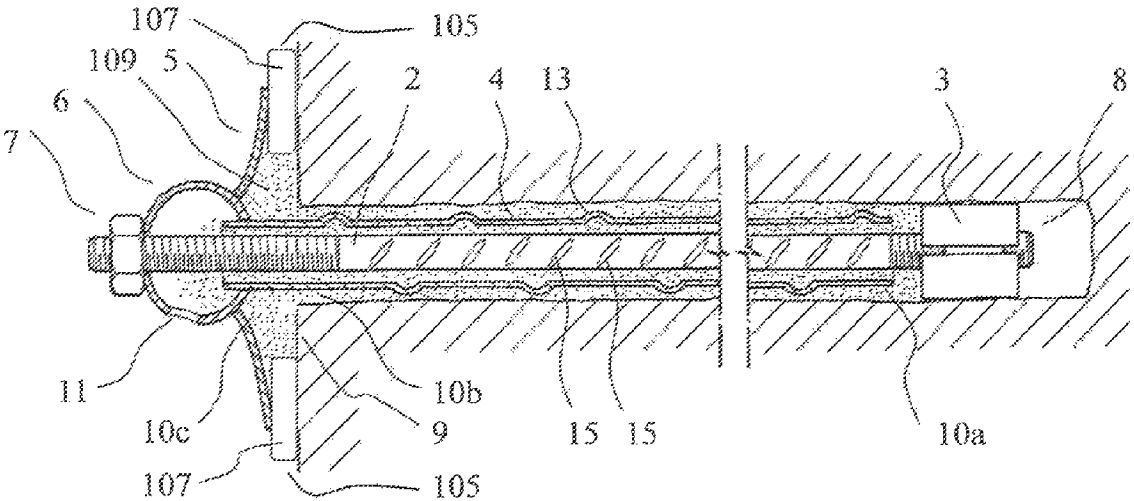
FIG. 5 is a side elevational view of the rock bolt seal of the present invention showing the placement thereof when installed, when used in conjunction with the prior art rock bolt shown in a side elevational view, partially in cross-section, in FIG. 2.

The positioning of seal 100 with respect to rock bolt 1 can best be understood when viewing FIG. 4 and FIG. 5. FIG. 4 corresponds to the exploded perspective view of prior art rock bolt 1 prior to installation of FIG. 1, showing the positioning of seal 100 distal to washer plate 5. FIG. 5 corresponds to the side elevational view, partially in cross-section, of prior art rock bolt 1 as installed of FIG. 2, showing the positioning of seal 100 distal to washer plate 5 and flush against rock face 9, with rod 2 and the proximal end of cylinder 4 protruding through void 109 of the inner dimension 107 of body 101 of seal 100.

To use the invention, distal end of rock bolt 1 is placed through the void 109 in the inner dimension 107 of the body 101 of seal 100 prior to (or as) the distal end of rock bolt 1 is placed in bore hole 8. As before, bolt 1 is pressed into bore hole 8 so that the distal end of bolt 1 is pushed towards the distal end of bore hole 8. Before the distal surface of washer plate 5 is pressed up against rock face 9, body 101 of seal 100 is aligned so that the outer edges of washer plate 5 rest within the outer edges 103 (defining outer dimension 105) of the body 101 of seal 100 so that the outer edges of washer plate 5 press up against the inner dimension 107 of the body 101 of seal 100. Once bolt 1 is in place with washer plate 5 flush against rock face 9 (with seal 100 pressed there-between), nut 7 is tightened to anchor bolt 1 in place through expansion of expansion bushing 3 is and cementing grout is inserted as before. With seal 100 in place, any gaps between rock face 9 and the external edges of washer plate 5 are filled by the inner dimension 107 of body 101. If void 109 is larger than the diameter of tube 4, cementing grout will be able to pass through airspace 10*c* and pass through to escape orifice 14, thereby signaling to the person installing the grout to stop the installation process once cementing grout starts to escape from escape orifice 14.

The inner dimension 107 of the body 101 of seal 100 has to be sufficiently wide (the width being the surface between the outer dimension 105 and the void 109) so that any portion of the inner dimension 107 is not blown out of the gap between the washer plate 5 and the rock face 9 by cementing grout as cementing grout fills airspace 10*c* between rock face 9 and the interior surface of washer plate 5, thereby opening the gap and allowing cementing grout to escape. Similarly, the spongy material that seal 100 is made of must be sufficiently strong so that such a blowout is unlikely.

Seal 100 can be made of any spongy material that will fill the previously described gaps when bolt 1 is installed in a bolt hole 8 to prevent, or at least lessen, the passage of cementing grout through the gaps for a sufficient time to allow the grout to harden. The inventor has found that carpet underlay is a suitable spongy material that is sufficiently flexible, durable and water-resistant. Carpet underlay is also a material that can be easily obtained. Carpet underlay can comprise one or more of the following substances: waffle rubber, urethane foam, and bonded urethane. Carpet underlay can be made of recycled material wherein the aforementioned substances can be reclaimed scrap of high density urethane foam used in furniture and automotive manufacturing and crumb rubber which is made from used car tires.

Seal 100 may be made by cutting out the seal 100 from a sheet of the spongy material, such as carpet underlay. Seal 100 with inner dimension 107 may be stamped from the sheet with a die having cutting surfaces matching those of outer dimension 105 and void 109. Alternatively, the cuts may be made with two separate dies or with a cutting edge such as a knife or scissors.

Carpet underlay that is of about 10 mm thickness has been found by the inventor to be particularly suitable. This thickness of material allows a planar seal 100 to be cut therefrom which is about 10 mm thick, which is sufficient to fill many gaps that a worker will encounter when applying cementing grout when installing a rock bolt. As used herein, about 10 mm refers to the thickness of the spongy material in its uncompressed state, and envisions material that is between 8 and 12 mm thick. If the rock face 9 is particularly jagged, larger gaps between the rock face 9 and the outer edges of washer plate 5 may be encountered. In such a case, two or three seals 100 may be stacked together to form a stack of seals 100 that is about 20 or about 30 mm thick. While it is possible to use more than a double or triple layer of seals 100, it may be more satisfactory to first apply more shotcrete (or similar material) to the rock face 9 in order to smooth out the surface of rock face 9 to minimize gaps.

While the inventor has found carpet underlay to be a satisfactory material from which seals 100 are cut, the person skilled in the art will understand that any planar, spongy material will be suitable so long as it is sufficiently flexible, resilient and water-resistant. Such materials include polyurethane foam rubber, latex foam rubber and neoprene.

The invention claimed is:

1. A rock bolt for installation in a borehole in a rock face, the rock bolt comprising:

a hollow cylindrical tube having an exterior surface with an exterior diameter and an interior surface providing an airspace within the tube;

a cylindrical rod having a threaded proximal end and a threaded distal end, wherein the rod comprises an expansion bushing mounted at the distal end thereof and a nut mounted at the proximal end thereof, wherein the rod extends through the hollow cylindrical tube between the nut and the expansion bushing, and wherein the airspace is between the interior surface of the tube and an exterior surface of the rod;

a pressure sphere and a washer plate mounted on the rod between the nut and the proximal end of the tube through central openings in the pressure sphere and the washer plate, wherein the pressure sphere has a grouting orifice, wherein the central opening of the pressure sphere has a proximal central opening that matches a diameter of the threading at the proximal end of the rod and a distal central opening that matches the exterior diameter of the tube such that, at the distal central opening of the pressure sphere, the pressure sphere is mounted on the exterior surface of the tube, and wherein the central opening of the washer plate is larger than the exterior diameter of the tube and, at the central opening of the washer plate, the washer plate rests flush against an outer surface of the pressure sphere, towards a distal portion of the pressure sphere; and a seal for placement between the washer plate and the rock face, wherein the washer plate has an outer edge at a perimeter thereof, wherein the seal comprises a body made of a spongy material, wherein the body is planar and has an outer dimension that matches that or that is larger than that of the outer edge of the washer plate and an inner dimension towards a center of the body, the body having a void through which the tube can pass.

2. The rock bolt according to claim 1, wherein the spongy material is a flexible, resilient and water-resistant material.

3. The rock bolt according to claim 2, wherein the flexible, resilient and water-resistant material comprises one or more materials selected from the group consisting of polyurethane foam rubber, latex foam rubber and neoprene.

4. The rock bolt according to claim 3, wherein the spongy material is of about 10 mm thickness.

5. The rock bolt according to claim 2, wherein the flexible, resilient and water-resistant material is carpet underlay.

6. The rock bolt according to claim 5, wherein the spongy material is of about 10 mm thickness.

7. The rock bolt according to claim 2, wherein the flexible, resilient and water resistant material comprises one or more materials selected from the group consisting of waffle rubber, urethane foam, and bonded urethane.

8. The rock bolt according to claim 7, wherein the spongy material is of about 10 mm thickness.

9. The rock bolt according to claim 1, wherein the void through which the tube of the rock bolt can pass allows for an airspace between the seal at the inner dimension thereof and the rock bolt along a longitudinal axis thereof.

* * * * *